United States Patent [19]

Tanaka

[11] 4,084,538

[45] Apr. 18, 1978

[54] AMBIENT TEMPERATURE COMPENSATING DEVICE FOR POWER SOURCE APPARATUS FOR DEVELOPING ELECTRODES

[75] Inventor: Masaaki Tanaka, Ebina, Japan

[73] Assignee: Rank Xerox, Ltd., London, England

[21] Appl. No.: 756,524

[22] Filed: Jan. 3, 1977

[30] Foreign Application Priority Data

Feb. 9, 1976 Japan ..... 51-12213

[51] Int. Cl.[2] ..... G03G 15/06

[52] U.S. Cl. ..... 118/4; 118/647

[58] Field of Search ..... 118/647, 648, 649, 650, 118/651, 4; 355/3 DD

[56] References Cited

U.S. PATENT DOCUMENTS

| | | | |
|---|---|---|---|
| 3,599,605 | 8/1969 | Ralston | 118/647 |
| 3,779,204 | 12/1973 | Altmann | 118/647 X |
| 3,889,637 | 6/1975 | North et al. | 118/651 |
| 3,898,001 | 8/1975 | Hardenbrook et al. | 118/647 X |
| 3,926,516 | 12/1975 | Whited | 118/647 X |
| 3,981,268 | 9/1976 | Tsukamoto | 355/3 DD X |

*Primary Examiner*—Mervin Stein
*Assistant Examiner*—Andrew M. Falik

[57] ABSTRACT

A developing electrode device for a copying machine using a photosensitive material relying on temperature can set values despite variations in and deterioration of the initial characteristic of the photosensitive material to always produce stabilized copy images. The device includes a power source having a detector for detecting the temperature of a photosensitive body, a linear amplification circuit for amplifying signals of the detector, a clamping circuit for clamping output voltages of the linear amplification circuit in excess of normal temperature, an addition circuit for permitting the output voltages of the linear amplification circuit to move in parallel within a range of ambient temperatures and means for supplying the output of said addition circuit to a developing electrode.

4 Claims, 5 Drawing Figures

BIAS VOLTAGE
600v
500
400
300
200
100
0
D
II
III
I
5
10
15
20
25
30
35
°C
AMBIENT TEMPERTURE

BIAS VOLTAGE
600v
500
400
300
200
100
0
VI
IV
I
V
5
10
15
20
25
30
35
°C
AMBIENT TEMPERATURE

AMBIENT TEMPERATURE COMPENSATING DEVICE FOR POWER SOURCE APPARATUS FOR DEVELOPING ELECTRODES

BACKGROUND OF THE INVENTION

The present invention relates to a power source for developing electrodes for electrophotographic copying machines.

In prior art electrophotographic copying machines, particularly dry-type copying machines which employ cascade development systems, representation of lines has been found good because of what is called the edge effect, whereas representation of photographs and half-tones has been limited. A developing method with developing electrodes has been employed in an effort to minimize this problem.

Developing with developing electrodes, however, has various technical difficulties. A typical one is to entirely and uniformly maintain a spacing distance between a developing electrode plate and a photosensitive body; another difficulty is that of maintaining a balance of three potentials, i.e., a developing electrode potential, an image potential of the photosensitive body, and a potential in a non-image portion of the photosensitive body (background potential).

The present invention is particularly directed to an improvement in the latter.

In conventional developing electrode developing methods for electrophotographic copying machines using a photosensitive body (hereinafter referred to as a photosensitive material relying on temperature), wherein the image potential of the photosensitive body and the background potential vary due to variation of ambient temperatures, it has been difficult to acquire balance of the above-mentioned three potentials even by applying constant charging electric current and exposure to the photosensitive body, which results in a difficulty in maintaining good quality copies. Particularly, early in the morning during the winter season, ordinary offices are not sufficiently heated, and the temperature often drops to a level below 5° C, as a consequence of which both the image potential and the background potential are greatly varied. Especially under the environment of low temperatures, the background potential rises to produce more foggy copies, resulting in a great displacement from the initial purpose of the developing electrode method employed to improve the copy quality.

In order to eliminate the disadvantages noted above, a prior art technology has been proposed which can always produce copies of good quality even if the ambient temperature should be varied. According to such proposals, a temperature sensor such as a thermistor or a thermocouple may be used to directly or indirectly detect a temperature of a photosensitive body or to detect a surface potential of the photosensitive body to activate a control circuit by a detection signal resulting therefrom; this sets a developing electrode voltage to an optimum value, thus always producing copies of good quality.

Such prior art devices, however, pose a drawback such that generally, the photosensitive material gradually deteriorates as the use thereof increases. This requires that the above-mentioned control circuit be corrected, particularly, where the temperature of the photosensitive body is detected, since it takes time to change a set value.

SUMMARY OF THE INVENTION

In view of the above, it is an object of the present invention to provide a power source for a developing electrode in a developing device of an electrophotographic copier using a photosensitive material relying on temperature, which power source is not affected by deterioration of the photosensitive material.

Another object of the present invention is to provide a power source for a developing electrode which can easily set values even after deterioration of the photosensitive material.

To effect the above objects, the present invention is directed to a power source for a developing electrode, the source including a detector for directly or indirectly detecting temperatures of a photosensitive material, a linear amplification circuit for amplifying signals of the detector and capable of suitably setting the amplification rate thereof, a clamping circuit for clamping output voltages of the linear amplification circuit in excess of normal temperatures, an addition circuit for permitting the output voltages of the linear amplification circuit to move in parallel within a range of ambient temperatures, and means for supplying the output of the addition circuit to the developing electrode.

DETAILED DESCRIPTION OF THE INVENTION

Figure 1:
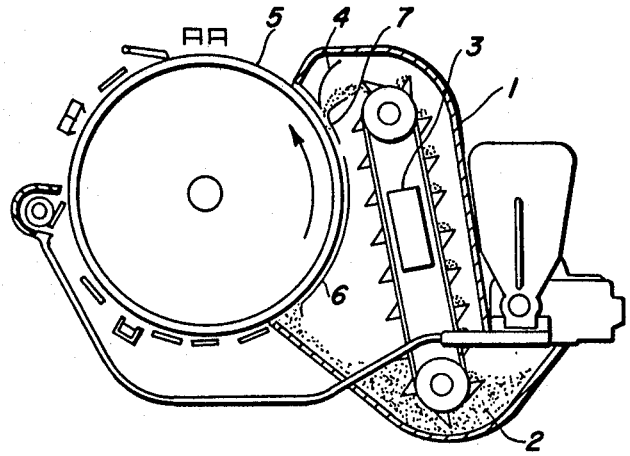
FIG. 1 is a schematic illustration of a developing device.

Referring to FIG. 1, a model of a cascade developing electrode development system is shown. A developer 2 stored in the bottom of a developer housing 1 is conveyed by a conveyor 3 to an entrance chute 4 located at the top of the housing 1. The developer supplied from the entrance chute 4 will drop along the passage formed between a drum or a photosensitive body 5 and a developing electrode which comprises a main electrode 6 and a clean-up electrode 7. A toner image is thereby formed on the drum or photosensitive body 5. At this time, the action of the main electrode 6 permits the development of large solid image areas by preventing the edge effect due to the intense line of electric force generated vertically between the drum surface and the electrode. When passed through the main electrode 6, the toner image then enters the portion of the clean-up electrode 7. A positive potential of approximately 1200V is built up across the clean-up electrode 7 to generate the intense line of electric force toward the drum surface. The intense line of electric force from the clean-up electrode 7 caused the toner in an infirm bonded condition to pull away from the background portion to obtain a clean copied image.

Figure 2A:
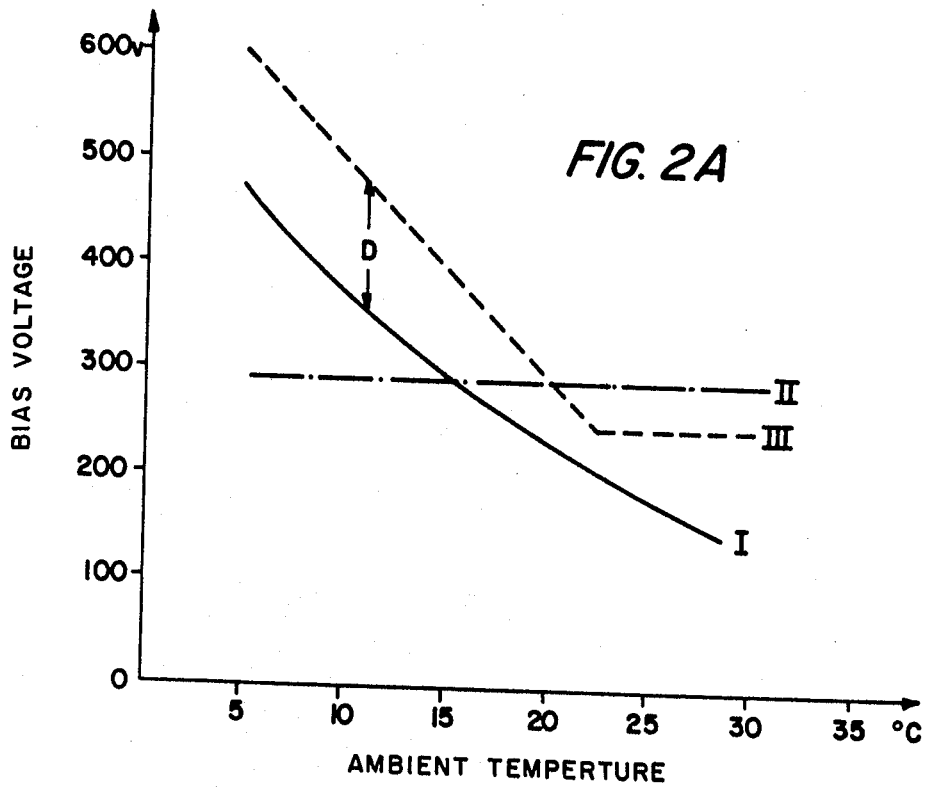
FIGS. 2A and 2B are graphic representations showing the background potentials of a photosensitive drum and the voltages of developing electrodes, each versus ambient temperatures.
Figure 2B:
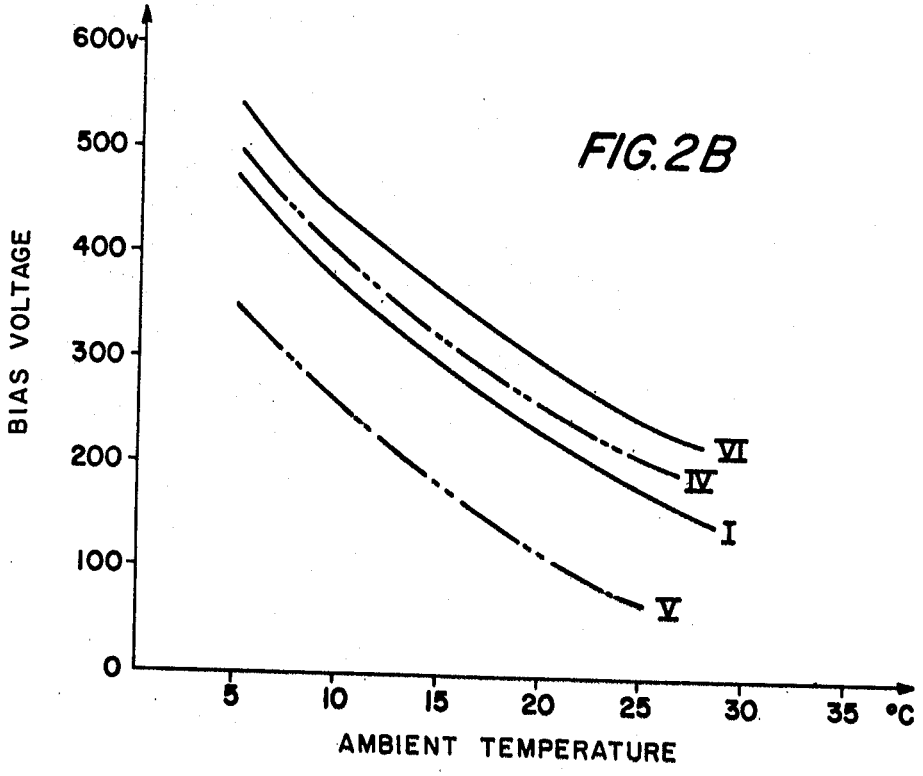

The model of fundamental development has just been described. One example of the background potential of the photosensitive material relying on temperature when the ambient temperatures are varied is shown in FIGS. 2A and 2B. Curve I represents the temperature characteristic sought by measuring the background potential of the photosensitive material relying on temperature. Where a constant developing electrode (300V, Curve II in FIG. 2A) is used as set forth in the prior art, the developing electrode potential will not adversely affect copy quality above 20° C since the developing electrode potential is higher than the background potential indicated by Curve I. Beneath 20° C, however, the developing electrode potential will produce adverse "foggy" copy results since the background potential indicated by Curve I becomes higher than the electrode potential indicated by Curve II. To solve this problem, a mechanism may be designed so that the developing electrode potential is allowed to have a temperature characteristic similar to that of the drum so as to render the difference between the developing electrode potential and the background potential (D in FIG. 2A) substantially constant even if the ambient temperature varies. This is indicated by Curve III in FIG. 2A. Curve III is determined on the basis of Curve VI in FIG. 2B. Curve VI represents the estimated variation of Curve IV when the amount of lamp light is reduced by 10% due to a lapse of time. The reason why the amount of lamp light is considered is that the reduction of the amount of lamp light caused by deterioration of the image exposure lamp causes the background potential of the photosensitive material to rise. Curve IV represents the upper limit of the confidence belt of 90% estimated by a Monte Carlo analysis with respect to Curve I in FIG. 2B (same as Curve I in FIG. 2A). Curve V in FIG. 2B represents the lower limit corresponding to the upper limit indicated by Curve IV.

The present invention provides a power source for developing electrodes having an output voltage characteristic as in the above-mentioned Curve III.

Figure 3:
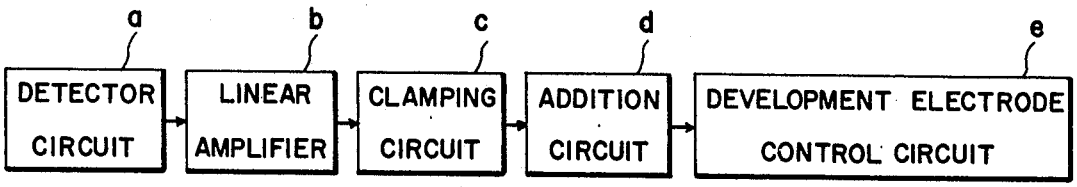
FIG. 3 is a block diagram showing a basic circuitry construction according to the present invention.

FIG. 3 is a block diagram showing a construction of a basical circuitry according to the present invention. A detector *a* (e.g. a bridge circuit and a thermistor), generates a signal according to variation of the ambient temperature which is regarded almost the same as the temperature of the photosensitive material. The signal from the detector *a* can be amplified by a linear amplifier *b*, and at this time, the amplification rate may suitably be set. Thereby, an inclination rate of the inclined range of the Curve III in FIG. 2A may suitably set as desired. A clamping circuit *c* receives an input of amplified signal from the linear amplifier *b*, and output voltage is controlled by the circuit *c* so that the output voltage gets constant (horizontal range of Curve III in FIG. 2A) at a temperature greater than the normal ambient temperature. Then, an addition circuit *d*, receives an input of an output signal from the clamping circuit *c*, and a suitable constant voltage is applied. This is required to cause the Curve VI in FIG. 2B to move in parallel. This output signal of the addition circuit may also directly be supplied to the developing electrode, or may also be entered into an output circuit which controls a developing electrode voltage as necessary.

Figure 4:
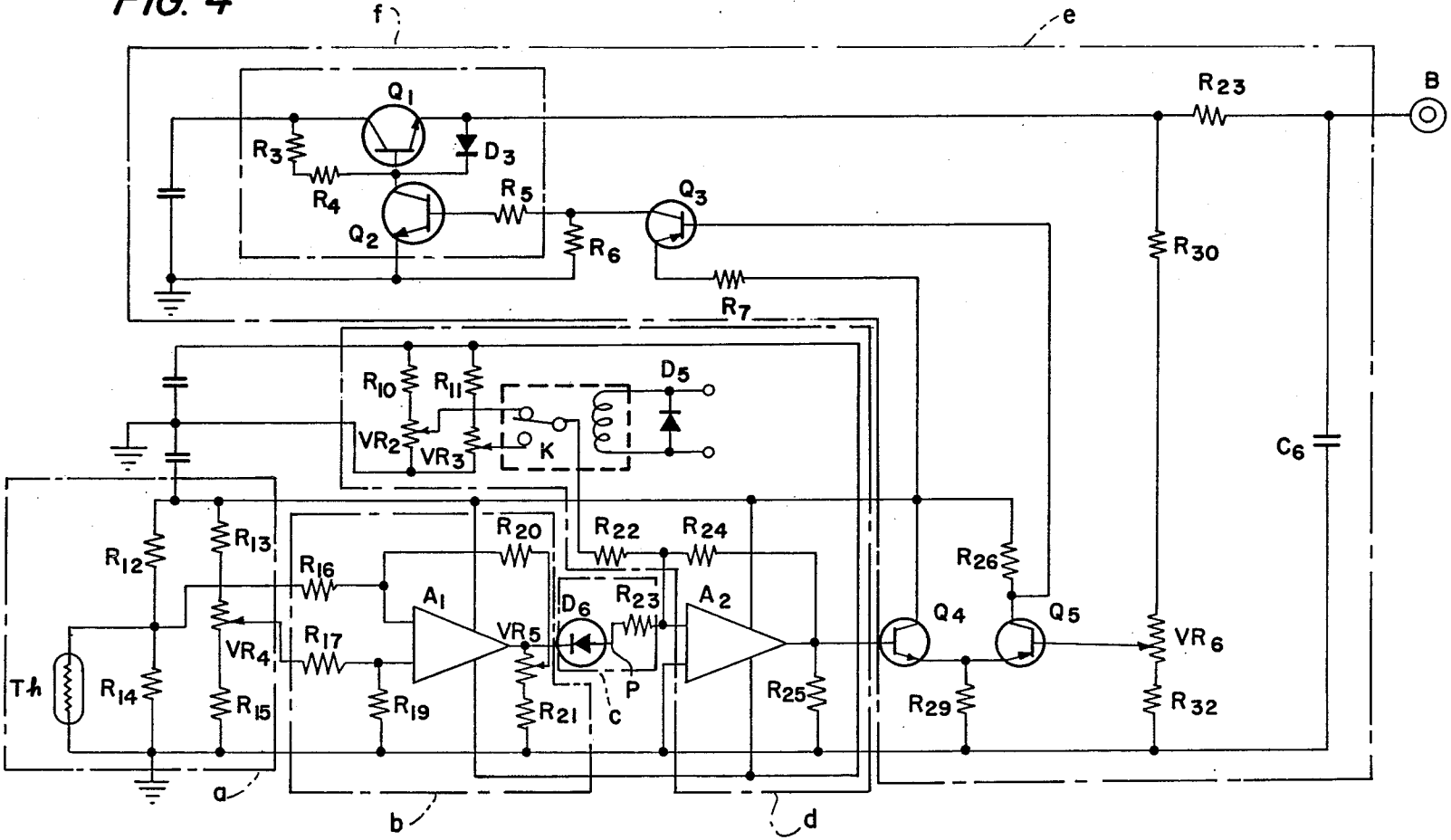
FIG. 4 is a circuit diagram of one embodiment of the present invention.

The aforementioned basic circuit construction in FIG. 3 may further be specified, which is shown in FIG. 4 in the form of an embodiment according to the present invention. While the voltage applied to the main electrode 6 is allowed to have the above-mentioned temperature characteristic in this embodiment, it should be noted that the clean-up electrode 7 can also be allowed in its potential to have the temperature characteristic similar thereto as needed.

A thermistor Th, which is provided to detect a temperature of the photosensitive drum 5, may be designed in direct contact with the drum 5 or may also be designed in contact with a frame which varies in temperature in a manner similar to the drum 5. The resistance temperature characteristic of the thermistor Th can be compensated and stabilized by a parallel resistor $R_{14}$. A detection signal of the thermistor Th is supplied to a differential amplifier $A_1$. The other input is supplied to the amplifier $A_1$ through resistors $R_{13}$, $R_{15}$ and a zero V regulating resistor $VR_4$. An output of the amplifier $A_1$ is applied through a clamping diode $D_6$ to an amplifier $A_2$. A voltage divided by resistor $R_{10}$, output voltage setting resistor $VR_2$ or $R_{11}$, and $VR_3$ is added to the output of the diode $D_6$. Since the gain of the amplifier $A_2$ is set to "1", the output voltage of the amplifier $A_2$ is merely level-shifted by merely reversing the input voltage thereof.

It is designed in the illustrated embodiment so that when the ambient temperature rises to decrease the resistance value of the thermistor Rh, the output of the amplifier $A_1$ increases from the negative value. The slope of output increase is selected to a suitable value by regulating a slope variable resistor $VR_5$ to vary a voltage gain of the amplifier $A_1$. Thereby, the signal from the thermistor Th is linearly amplified in the range of temperature (for example, from 0° to 30° C) as desired. When the output voltage of the amplifier $A_1$ is less than a predetermined value (for example, O V) (that is, negative potential), a potential at point P in FIG. 4 is preset so that the diode $D_6$ may be forward biased, as a consequence of which during that time, the input voltage of the amplifier $A_2$ may vary as the output voltage of the amplifier $A_1$ varies. When the ambient temperature rises so that the output of the amplifier $A_1$ exceeds a predetermined value (for example, positive potential), the diode $D_6$ is backward biased to clamp the output voltage from the amplifier $A_1$ at the predetermined value, whereby the output voltage of the amplifier $A_2$ becomes a given value at a temperature above the normal ambient temperature (22.5° C in this embodiment). To accurately set the clamp point as mentioned above, the zero V regulating resistor $VR_4$ is used. That is, this resistor $VR_4$ can be regulated so that the output of the amplifier $A_1$ assumes the predetermined value (for example, O V) at the normal ambient temperature as previously mentioned. Thereby, variations in characteristics of the photosensitive drum 5 and thermistor Th may be compensated. Any one of voltages obtained at the output voltage setting resistors $VR_2$ or $VR_3$ may be selected by a relay K and applied to the output of the amplifier $A_1$, whereby the output voltage having similar temperature characteristics to the Curve VI (FIG. 2B) may be obtained at the amplifier $A_2$, and the above-mentioned curve may be moved in parallel within a range of ambient temperatures and the output voltage may simultaneously be switched. In this manner, the output may be set to an optimum value according to the ground color of copy originals or light and shade of characters of originals.

While a description has been given, in the foregoing, of the case where the differential amplifier is used to serve as the amplifier $A_1$, it should of course be noted that a conventional amplifier may also be used. In the case of the conventional amplifier, however, if the output thereof (that is, the Curve IV in FIG. 2) is allowed to keep the linearity in the range of temperatures, for example from 5° to 30° C, a thermistor whose B constant is in excess of 5,000 must be used, and in addition, there is a limitation that a suitable resistance value cannot be used in relation to an input impedance of the amplifier. As opposed thereto, in the case the differential amplifier is used, there is present no limitation noted above and besides, the slope may suitably be adjusted with the linearity remained kept, and as a result, it affords the advantages such that there requires no circuit constant and replacement of devices with respect to the photosensitive drum different in the temperature characteristic, but mere re-regulation of variable resistors will suffice for sufficient application, thus providing a high all-round usability. It is reported by the present inventor that in the case of the differential amplifier, the best result was obtained with the gain thereof set to 10 to 50 times.

As previously mentioned, since the output of the amplifier $A_2$ may obtain the desired voltage and temperature characteristic as shown by the Curve VI in FIG. 2, this can also be used as the developing electrode voltage without modification, and a transistor $Q_1$ in the series pass circuit *f* (FIG. 4) inserted in the developing electrode power source may directly be controlled by the output of the amplifier $A_2$. Actually, however, the desired linearity must be obtained in the amplifier $A_1$ by selecting an amplification rate thereof which will result in a greater variable range of output voltage of the amplifier $A_2$ so that if the transistor $Q_1$ in the series pass circuit inserted in the developing electrode power source should directly be driven, another variable range of output voltage obtained at an output terminal B would also sometimes be displaced from the desired range. In the illustrated embodiment, a buffer circuit comprising transistors $Q_3$ through $Q_5$ is provided to convert the aforesaid variable range into the voltage range as specified. When the ambient temperature is lowered to rise the output voltage of the amplifier $A_2$, a collector electric current of transistor $Q_4$ increases and a voltage drop due to resistor $R_{27}$ also increases to thereby decrease a collector current of transistor $Q_5$. For this reason, a collector potential of transistor $Q_5$ rises to decrease a collector current of transistor $Q_3$, and as a result, a base current of transistor $Q_2$ also decreases to thereby rise a collector potential of transistor $Q_2$, and an emitter potential of transistor $Q_1$ or a potential of output terminal B also rises. When the rise of output voltage of the amplifier $A_2$ becomes greater and the emitter potential of transistor $Q_5$ exceeds the base potential thereof, the transistor $Q_5$ is cut off so that no further change is occurred with the emitter potential of transistor $Q_1$ or output voltage at the terminal B held constant in value. That is, the maximum value of output voltage in the circuit according to the present embodiment is restrained to a given value determined by setting a shift variable resistor $VR_6$. For this reason, the output voltage is constant at the ambient temperature less than a certain predetermined value to thereby avoid the relative lowering of contrast potential due to excessively high developing electrode potential, thus preventing the contrast of copy from being deteriorated.

It will be noted that a resistor $R_{28}$ and a capacitor $C_6$ constitutes an integrating circuit, which serves to remove overshoot of output voltage at the time of poweron, and the transistors $Q_1$ to $Q_3$ and $Q_5$ and the shift variable resistor $VR_6$ are also useful for voltage stabilization due to the principle of constant voltage device.

Figure 5:
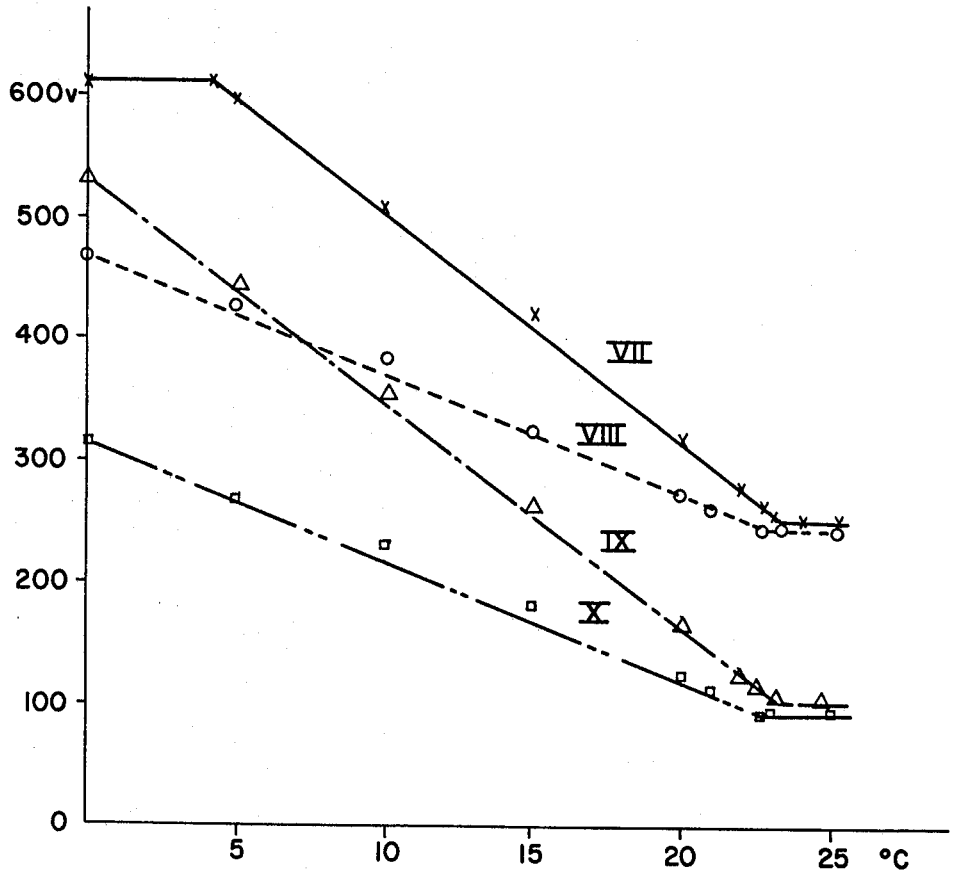
FIG. 5 is a graphic representation showing output characteristics obtained by apparatus constructed according to the present invention.

FIG. 5 shows actual output characteristics of the device according to the illustrated embodiment as previously described. Curve VII represents the slope with the $VR_5$ set to maximum and the gain of amplifier $A_1$ set to maximum, whereas Curve VIII represents with the $VR_5$ set to minimum. Curves IX and X is in a condition where a relay signal is level-shifted from "H" to "L", by which the output characteristic of the present invention is confirmed.

As can be seen the present invention provides a developing electrode device for copying machines using a photosensitive material relying on temperature, which can easily set values despite of variations in the initial characteristic of the photosensitive material and of deterioration of the initial characteristic to thereby always produce stabilized copying images.

What is claimed is:

1. A power source for a developing electrode comprising:
   - a detector for detecting the temperature of a photosensitive body;
   - a linear amplification circuit for amplifying signals of the detector,
   - a clamping circuit for clamping output voltages of the linear amplification circuit in excess of normal temperature;
   - an addition circuit for permitting the output voltages of the linear amplification circuit to move in parallel within a range of ambient temperatures; and
   - means for supplying the output of the addition circuit to the developing electrode.

2. A power source as set forth in claim 1, including a power source circuit provided with a series pass circuit controlled by the output of the addition circuit.

3. A power source as set forth in claim 1 wherein the linear amplification circuit comprises a differential amplification circuit.

4. A power source as set forth in claim 2 wherein the linear amplification circuit comprises a differential amplification circuit.

* * * * *